US008564144B1

(12) United States Patent
Rome et al.

(10) Patent No.: US 8,564,144 B1
(45) Date of Patent: Oct. 22, 2013

(54) LIGHT-WEIGHT HUMAN GENERATED ELECTRICITY

(75) Inventors: Lawrence C. Rome, Stafford, PA (US); Haldun Komsuoglu, Philadelphia, PA (US); Gerald Marron, Broomall, PA (US); Rajid Rana, Princeton, NJ (US)

(73) Assignee: Lightning Packs, LLC, Strafford, PA (US)

( * ) Notice: Subject to any disclaimer, the term of this patent is extended or adjusted under 35 U.S.C. 154(b) by 53 days.

(21) Appl. No.: 13/111,755

(22) Filed: May 19, 2011

Related U.S. Application Data

(60) Provisional application No. 61/346,324, filed on May 19, 2010.

(51) Int. Cl.
*H02K 7/18* (2006.01)

(52) U.S. Cl.
USPC ..... 290/1 C

(58) Field of Classification Search
USPC ..... 290/1 C, 1 E
See application file for complete search history.

(56) References Cited

U.S. PATENT DOCUMENTS

| | | | | |
|---|---|---|---|---|
| 4,911,346 | A * | 3/1990 | Shallman | 224/631 |
| 6,229,224 | B1 * | 5/2001 | Gagne | 290/1 R |
| 6,982,497 | B2 | 1/2006 | Rome | |
| 7,119,451 | B2 * | 10/2006 | Baarman et al. | 290/43 |
| 7,345,407 | B2 * | 3/2008 | Tanner | 310/339 |
| 7,703,562 | B2 * | 4/2010 | Kalik | 180/8.1 |
| 7,851,932 | B2 | 12/2010 | Rome et al. | |
| 2008/0179358 | A1 * | 7/2008 | Redzisz et al. | 224/155 |
| 2009/0015022 | A1 * | 1/2009 | Rome et al. | 290/1 A |
| 2009/0085530 | A1 * | 4/2009 | Matsubara | 320/166 |
| 2010/0006610 | A1 * | 1/2010 | Stinnett et al. | 224/153 |
| 2010/0013241 | A1 * | 1/2010 | Yeh | 290/1 |
| 2010/0026142 | A1 * | 2/2010 | Jones et al. | 310/339 |
| 2013/0049374 | A1 * | 2/2013 | Chen | 290/1 R |

* cited by examiner

*Primary Examiner* — Tulsidas C Patel
*Assistant Examiner* — Viet Nguyen
(74) *Attorney, Agent, or Firm* — Woodcock Washburn LLP

(57) ABSTRACT

A human powered electricity generator includes a suspension system including a compliant mechanism that permits a first portion of the suspension system to be displaced relative to a second portion of the suspension system as a result an application of force to the first or second portions of the suspension system. A generator converts the mechanical displacement of the first portion of the suspension system with respect to the second portion of the suspension system into electrical energy and stores the electrical energy in an energy storage device. Displacement means, such as a handle or a seat, is connected to either the first portion or the second portion of the suspension system to enable a user to manually displace the first portion of the suspension system with respect to the second portion of the suspension system so as to increase the efficiency of the energy generation. The stroke distance may be increased using a turnbuckle adjuster or an adjustment device that adjusts the length of the holder that holds the compliant mechanism in place. Extendible feet attached to one of the first and second portions of the suspension system also may be used to increase the mechanical displacement distance. The electricity generating device of the invention enables a user to produce electricity by hand pumping even when the user is not walking.

5 Claims, 11 Drawing Sheets

(b)

(a)

150

LIGHT-WEIGHT HUMAN GENERATED ELECTRICITY

CROSS-REFERENCE TO RELATED APPLICATIONS

The present application claims priority to U.S. Provisional Patent Application No. 61/346,324, filed May 19, 2010. The content of that application is incorporated herein by reference in its entirety.

STATEMENT OF FEDERALLY SPONSORED RESEARCH

Portions of the disclosure herein may have been supported in part by a grant from the Office of Naval Research, Grant No. N00014-08-C-0279. The United States Government may have certain rights in the invention.

TECHNICAL FIELD

The invention relates to an electricity generating device and, more particularly, to a light weight electricity generator that is powered by a human and implemented, for example, in a backpack.

BACKGROUND

People working off the electricity grid (soldiers, first responders, humanitarian relief workers, etc.) need to be able to generate their own electricity. Rome described in U.S. Pat. Nos. 7,851,932 and 6,982,497 (the contents of which are incorporated herein by reference) electricity-generating backpacks that provide human-generated electricity. The electricity-generating backpacks include a mass, an adjustable spring, and a generator to remove electricity. The devices enable a human to drive the kinetic movement of the spring-mass system.

The afore-mentioned electricity generating backpacks have been found to be quite useful to meet the electricity needs of soldiers, such as Marines. To determine effectiveness, one has to determine the daily electricity usage budget of the typical soldier as well as the daily electricity production budget. One recent estimate determined that Marines use an average of 5 W of electricity. Over a 24 hour period, this corresponds to $4.32*10^5$ Joules or 120 Watt-hours of electricity. To generate this level of electricity, the product of electrical power and the duration over which it is produced must be determined. If it is assumed that a mission might take 4-10 hours of walking and generate 8-20 W over that time, that is equivalent to 32-200 Watt-hours of electricity. However, if the only source of power from the backpack was generated during walking, there may be some days where the user does not walk enough to generate the necessary power to keep the batteries fully charged. A modification is thus desired whereby a user may use the electricity generating backpack to generate electricity without walking. The present invention is designed to meet this need.

SUMMARY

A very light device is provided that includes two hollow tubes, a spring, and a generator. The device is actuated much like a bicycle pump whereby a user can push against the spring (a compression or extension spring) and the electricity is generated on the down stroke as well as the upstroke as the spring returns the handle to its original position. Such a device can be reasonably effective, especially when a mass is used, as in the case of the afore-mentioned backpack.

The invention thus provides a human powered electricity generator including a suspension system including a compliant mechanism that permits a first portion of the suspension system to be displaced relative to a second portion of the suspension system as a result of an application of force to the first or second portions of the suspension system. The suspension system may include a load such as a load of a backpack or the load may be the weight of the user. A generator converts the mechanical displacement of the first portion of the suspension system with respect to the second portion of the suspension system into electrical energy and stores the electrical energy in an energy storage device. Displacement means, such as a handle, which may be foldable, is connected to either the first portion or the second portion of the suspension system to enable a user to manually displace the first portion of the suspension system with respect to the second portion of the suspension system so as to increase the efficiency of the energy generation. A seat may also be connected to either the first portion or the second portion of the suspension system to enable the user to use his full body weight to displace the first portion of the suspension system with respect to the second portion of the suspension system via extensible or compressible springs.

Several embodiments are provided for increasing the stroke distance and the distance to the ground without having to necessarily increase the spring constant. For example, a turnbuckle adjuster may be used to adjust the height of the first and second portions of the suspension system relative to a surface so as to increase the mechanical displacement of the first portion of the suspension system with respect to the second portion of the suspension system when force is applied to the displacement means.

In another embodiment, extendible feet may be attached to one of the first and second portions of the suspension system so as to increase the mechanical displacement of the first portion of the suspension system with respect to the second portion of the suspension system when force is applied to the displacement means.

In yet another embodiment, means are provided for adjusting the length of an adjuster that connects the compliant mechanism to one of the first and second portions of the suspension system.

Means may also be provided for switching between a first set of spring or damping parameters for generating electricity through walking movement and a second set of spring or damping parameters for generating electricity through hand pumping. For instance, utilizing the SEPIC converter of U.S. Pat. No. 7,851,932, the resistance emulated can be altered to adjust the amount of current removed and thereby a damping coefficient of the storage device to optimize power output. For example, the damping coefficient may be adjusted by changing a resistance that the storage device is emulating by adjusting a rotary switch with fixed resistors or a potentiometer. The electricity generating device of the invention thus functions to produce electricity even when the user is not walking.

In other exemplary embodiments, the electricity generator of the invention also includes a mass connected to the suspension system for displacement by the displacement means. The mass may be a load in a backpack connected to the suspension system and/or the weight of a user on the seat for displacing the first portion of the suspension system with respect to the second portion of the suspension system.

A variety of different generators may be used to convert displacement into electrical energy in accordance with the invention. For example, the generator may be a planetary gear generator that is driven by a rack and pinion gear responsive to movement of the suspension system by the displacement means. Alternatively, the generator may be a spur geared generator or a linear generator responsive to movement of the suspension system by the displacement means. In addition to being driven by a rack and pinion gear, the generator may be driven by a belt that drives the generator in response to displacement of the belt by the displacement means. In exemplary embodiments, the displacement means may further include a slip clutch or a spring that slows cranking of the generator by the mechanical displacement when a large inertial force is applied to the electricity generator.

A power monitoring node may also be provided to measure the generated electricity. The power monitoring node is preferably located between the generator and electronics for processing and storing the generated electricity. The power monitoring node measures and cumulates (integrates) over time the power generated by the generator for display on a display of the power monitoring node.

The suspension system may also be "ruggedized" for environmental conditions by including a roller bearing assembly that permits the first portion of the suspension system to be displaced relative to the second portion of the suspension system along at least one rod as a result of the application of force to the first or second portions of the suspension system, where the roller bearing assembly comprises three roller bearings situated at approximately 120 degree angles around and in contact with the at least one rod. In another "ruggedized" embodiment, the roller bearing assembly may comprise a cart that moves up and down respective orthogonally disposed arms of a V shaped track in response to the application of force, where the cart has at least two orthogonal rollers that roll in respective planes of the respective orthogonally disposed arms of the V shaped track.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements shown. In the drawings.

DETAILED DESCRIPTION OF ILLUSTRATIVE EMBODIMENTS

A detailed description of illustrative embodiments of the present invention will now be described with reference to FIGS. 1-11. Although this description provides a detailed example of possible implementations of the present invention, it should be noted that these details are intended to be exemplary and in no way delimit the scope of the invention.

Figure 1:
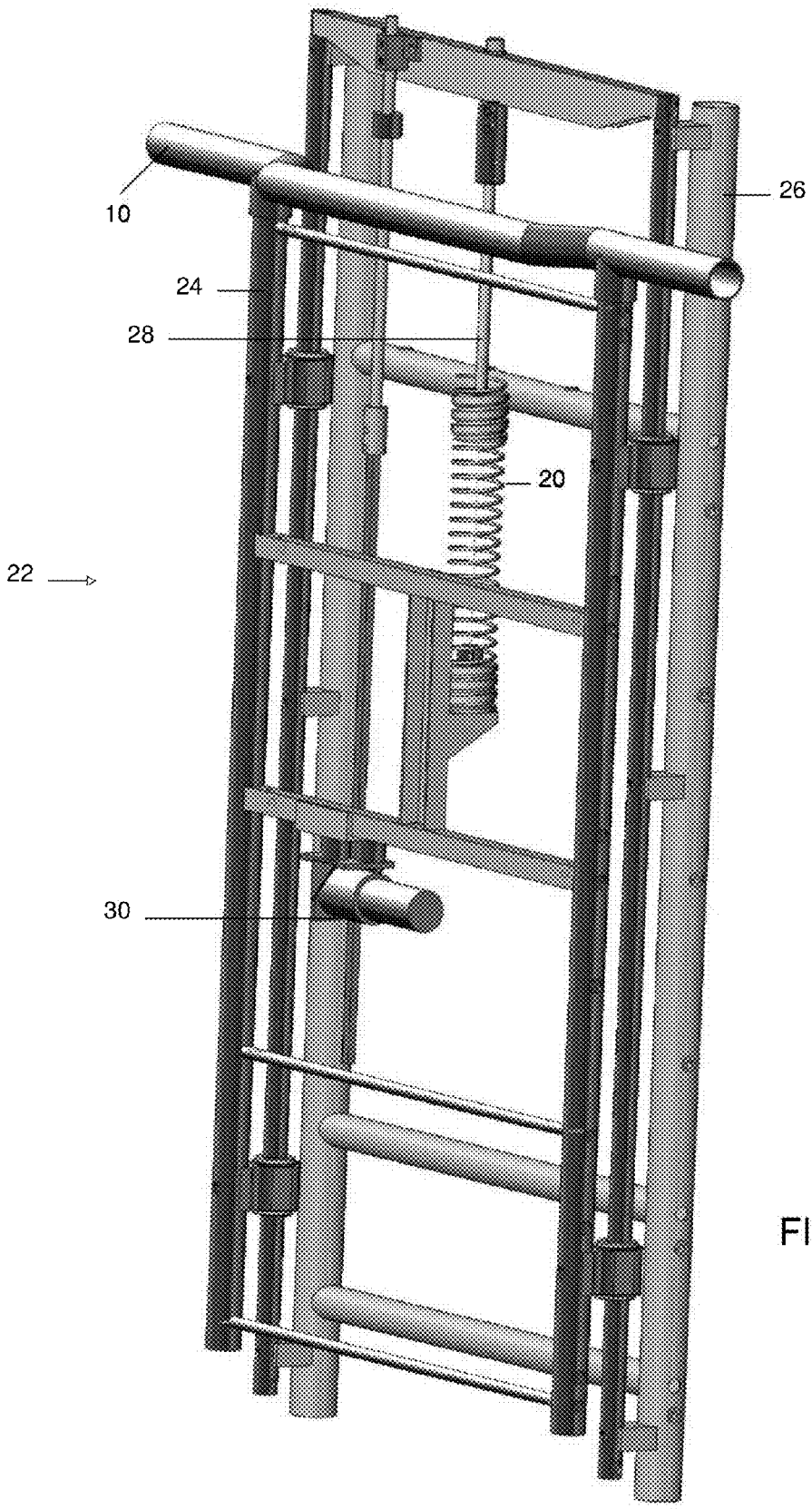
FIG. 1 illustrates a human powered electricity generation system in accordance with a first exemplary embodiment of the invention.

The inventors have modified the electricity generating backpack described in U.S. Pat. No. 7,851,932 so that it may double as an electric generator that may be actuated without walking so that electrical power may be generated even during periods when the soldier/user is stationary or camped. This supplementary form of electricity generation may be used to maintain charge on the batteries. After examining actuating the pack with one's feet as described in an embodiment of the electricity generating backpack described in U.S. Pat. No. 7,851,932, one of the present inventors found that an extremely effective way to generate electricity was by hand-pumping the electricity generator. When hand pumping, the backpack is placed vertically with the bottom of the frame resting on the ground. Either by hand or with the aid of a lightweight handle 10 as shown in FIG. 1, the user simply pushes down and then lets the spring 20 return the mass (typically of the contents of the backpack). (It is noted that FIG. 1 shows only the backpack electricity generating frame without the backpack or the load.) This pumping is repeated at a relatively high frequency (0.5-2 Hz). During testing, it was discovered that it was quite easy to generate 40 W of electricity over 15 to 30 minute periods by hand pumping. After a relatively short rest, this process could be repeated. In the tests, over 70 W could be generated. It is possible that large and strong individuals could maintain that level of electricity generation for considerable periods of time.

As described in more detail in U.S. Pat. No. 7,851,932, the electricity generating backpack or human generated electricity generator in accordance with the invention includes a suspension system 22 including a compliant mechanism (spring 20) that permits a first portion 24 of the suspension system 22 to be displaced relative to a second portion 26 of the suspension system 22 as a result an application of force to the first or second portions of the suspension system. The spring 20 is connected to the second portion 26 of the suspension system 22 via a spring adjuster 28. A generator 30 converts a mechanical displacement of the first portion 24 of the suspension system with respect to the second portion 26 of the suspension system into electrical energy. Electronics, such as the SEPIC converter described in U.S. Pat. No. 7,851,932 (not shown) charges a battery as well as provides power for attached devices. An energy storage device (not shown) stores the electrical energy for use.

It should be noted that the backpack of FIG. 1 is set so that its natural frequency matches the stepping frequency of the user. This frequency is typically set to be approximately 2 Hz. However, 2 Hz is not necessarily the ideal frequency for hand pumping as the optimal hand pumping frequency may be lower. Another limitation is that the stroke distance is limited by the fact that the mass (e.g., a backpack load in a backpack embodiment) hits the ground after a relatively short downward stroke.

In use, the spring adjuster 28 moves the equilibrium position of the load further off the ground. However, when this is done, it increases the spring constant (K) and thus moves the natural frequency (square root (K/mass)) even further from optimal for hand pumping. So what is needed is a manner to increase the stroke without having to increase the spring constant. Ultimately, it is desired to alter the equilibrium position and the spring constant independently.

Figure 2:
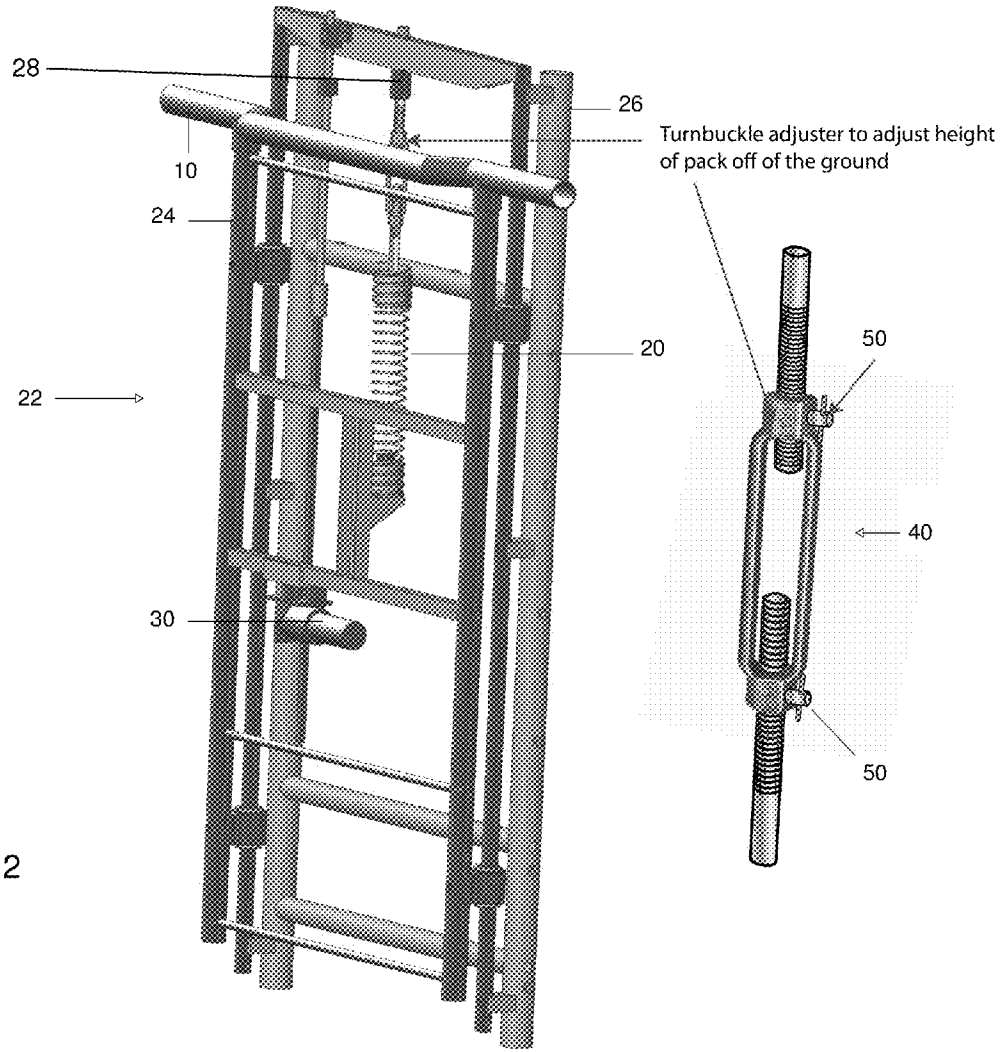
FIG. 2 illustrates an alternative embodiment of the human powered electricity generation system of FIG. 1 in which a turnbuckle adjuster is used to adjust the height of the backpack load relative to the ground.

To address this issue and to provide a greater stroke distance, in a first embodiment, a turnbuckle spring adjuster 40 may be used to adjust the height of the backpack with respect to the ground as shown in FIG. 2. As illustrated, locking pins 50 prevent the turnbuckle 40 from unlocking.

Figure 3:
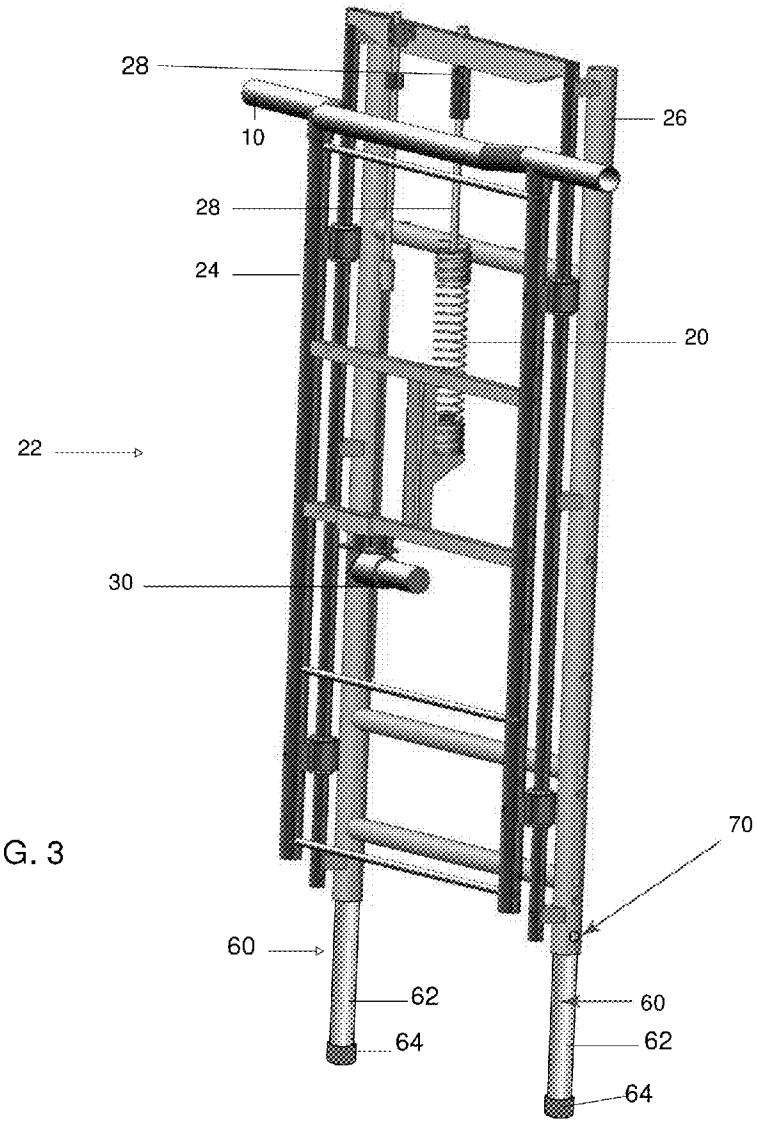
FIG. 3 illustrates an alternative embodiment of the human powered electricity generation system of FIG. 1 in which extendible "feet" are provided to allow more movement of the backpack load relative to the ground.

Alternatively, in a second embodiment, "feet" 60 comprising, for example, removable aluminum extensions 62 and rubberized stoppers 64 for friction, may be placed on the bottom of the backpack frame using a spring loaded lock 70 as illustrated in FIG. 3. The feet 60 move the frame further off the ground, thereby providing room for a larger stroke and permitting the independent adjustment of the spring constant.

Figure 4:
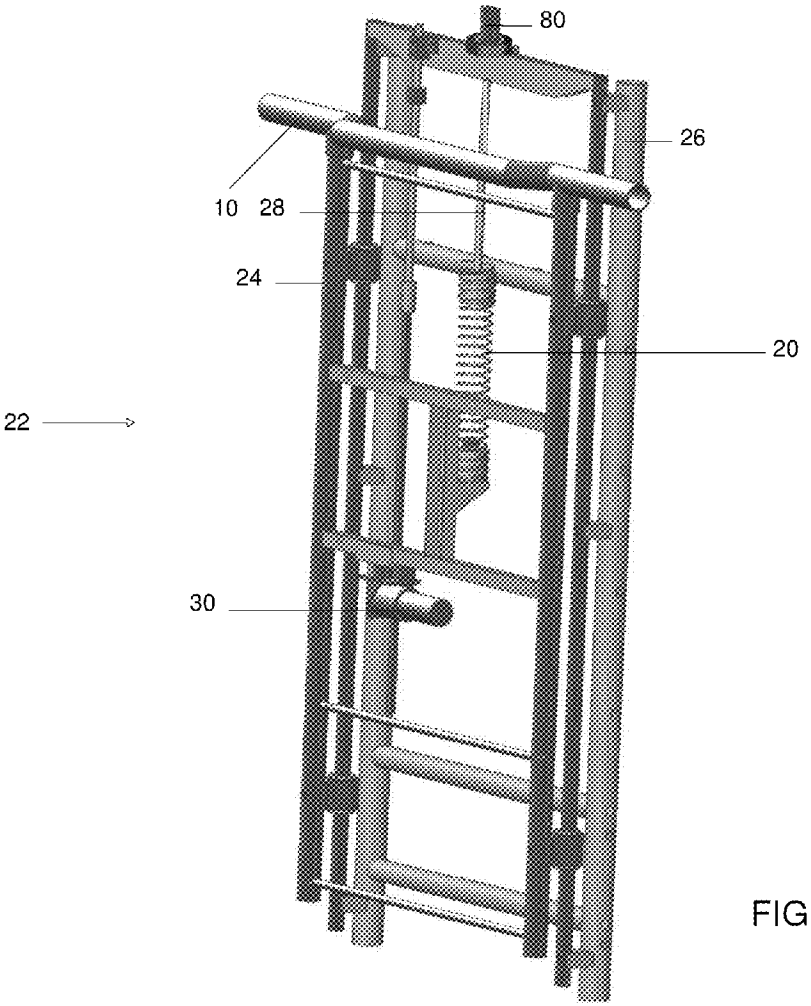
FIG. 4 illustrates an alternative embodiment of the human powered electricity generation system of FIG. 1 in which a mechanism is provided to adjust the length of the spring holder to provide a greater stroke length relative to the ground.

In a third embodiment, a mechanism 80 is provided by which the length of the spring holder on the top of the frame can be translated up through the top of the frame (or shortened) to provide a greater stoke length independent of spring constant. Such a mechanism is illustrated in FIG. 4.

In all of these embodiments, the frequency response of the system may be adjusted by either adjusting the spring constant (with the adjustable spring mechanism) or adjusting the damping coefficient of the generator/electronics by adjusting the amount of electrical power removed. The damping coefficient can be easily altered by changing the resistance that the electronics, such as a SEPIC converter (U.S. Pat. No. 7,851,932), is emulating, by use of a rotary switch with fixed resistors or a potentiometer. Those skilled in the art will appreciate that although it may not be necessary to rectify the current since the system could just generate electricity on the way down (DC motor), it is still necessary to control the current taken out. For example, if the generator is connected straight to the battery, the generator may see a short and it would not move. In an exemplary embodiment, the damping of the electronics, as opposed to the energy storage device, is adjusted by removing current unless it is desired to include the damping electronics in the electricity generating device.

As mentioned, because of biomechanical differences between walking and hand-pumping, the optimal frequency of hand pumping is not necessarily the same as that of walking (it is likely at a lower frequency). After determining what the optimal conditions for hand-pumping are, should they differ from those for walking, the appropriate spring or damping parameters may be built into the system so that the backpack may be "switched" to different modes for hand pumping vs. walking This will permit a user/soldier to generate all the electricity that he/she needs.

Folding Handle Embodiment

Figure 5:
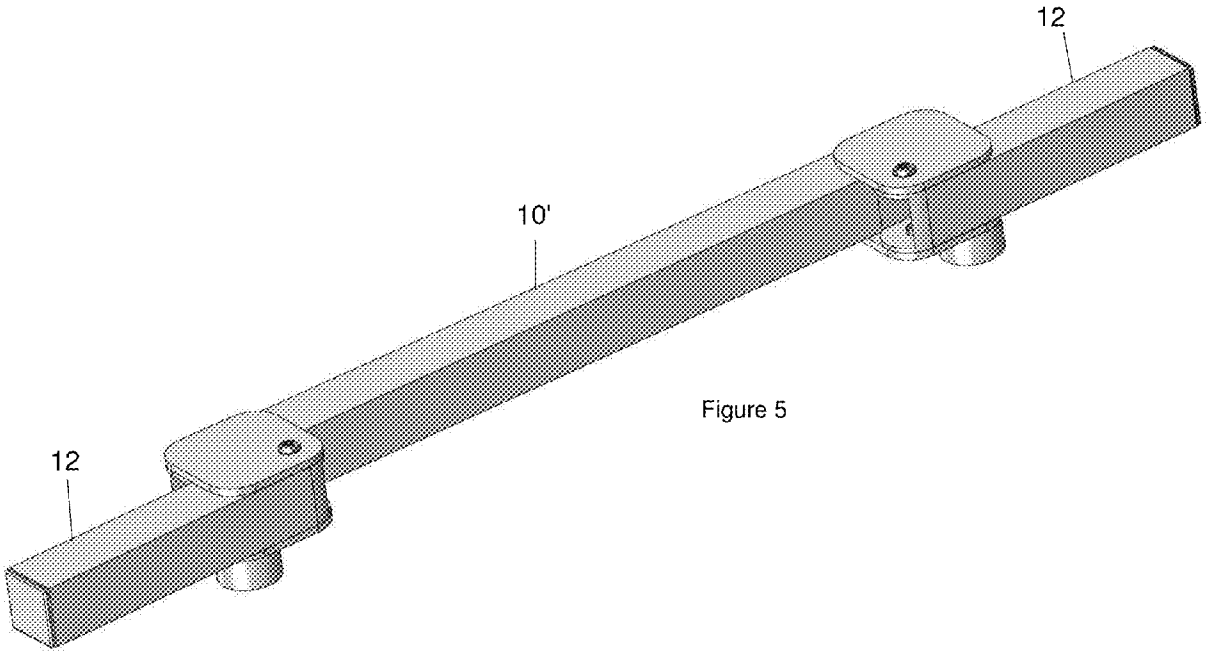
FIG. 5 illustrates a foldable handle for use with the embodiment of FIGS. 1-4.

Utilizing a lightweight handle to hand pump the backpack is beneficial for several reasons. First, if one push just with the hands, the force on left and right side of the suspension system 22 may not be even and this will tend to put unnecessary moments on the bearings of the suspension system which can lead to damage or reduced life. In addition, if one is hand pumping with bare hands for tens of minutes, the backpack fabric can abrade the skin. Long handles are difficult to pack into a backpack. FIG. 5 shows a foldable handle 10' where the hand grips 12 can be folded along its length reducing the overall length. This can be easily attached to the outside of the pack. Those skilled in the art will realize that there is a multitude of ways that the handle 10' could be folded.

Seated Displacement Embodiments

Figure 6:
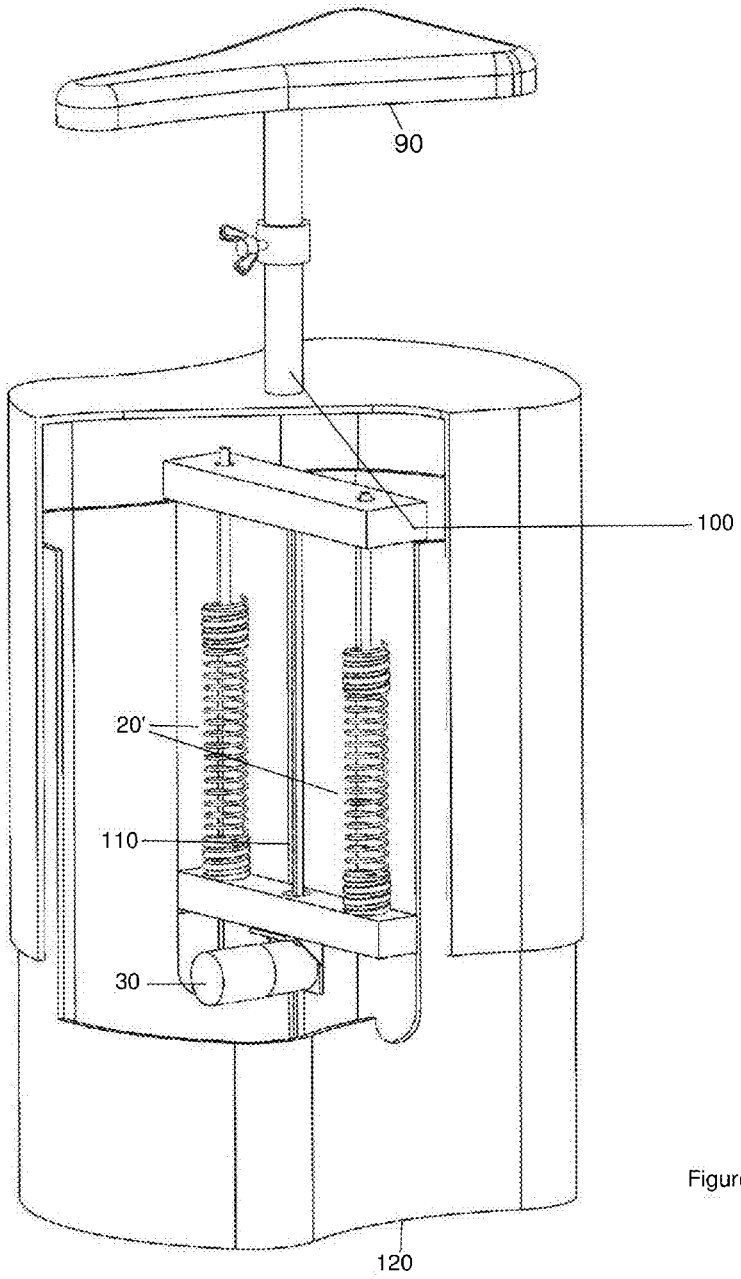
FIG. 6 illustrates an embodiment in which a seat may be removably placed on the top of the system of FIGS. 1-5 in place of the handle such that the user may either sit on it like a chair or sit astride like a bicycle seat.

Although the embodiment of FIGS. 1-5 can be reasonably effective, it would be more effective if a mass was involved. In the backpack embodiments, the mass is provided by the load being carried. However, if one is not carrying a mass, to carry one just to generate electricity would increase the weight of the system. Alternatively, the mass of the user can be used to complete the spring-mass system. For example, FIG. 6 illustrates an embodiment in which a seat 90 may be removably placed on the top of the system of FIGS. 1-5 in place of the handle 10 such that the user may either sit on it like a chair or sit astride like a bicycle seat. Ideally, at the top of the stroke, the user's toes would be just touching the ground and the user would allow his weight to be pressed on the seat which would drive the seat down (legs bent). At the bottom of the stroke, the legs would extend and thereby help the spring(s) 20' to buoy him/her back up.

Figure 7:
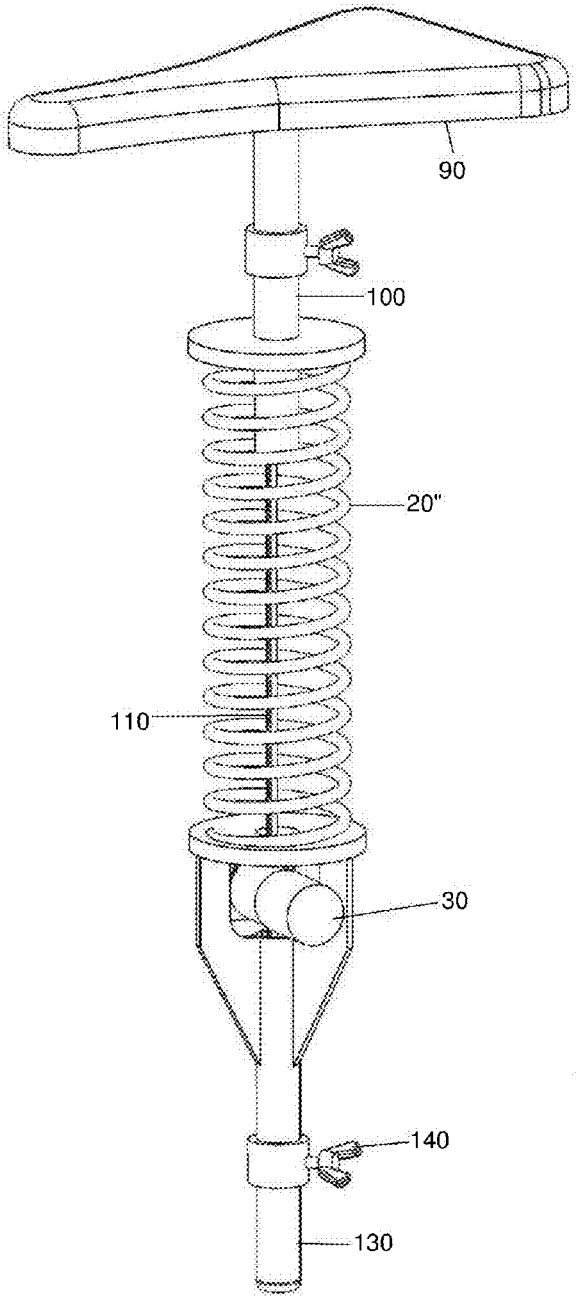
FIG. 7 illustrates a variation of the embodiment of FIG. 6 including a compressible spring and a rack and pinion gear for driving a planetary gear generator.

Those skilled in the art will realize that a proper stroke may be accomplished by using an extension spring system 20' as in FIG. 6 or a compression spring system 20" as in FIG. 7. In both cases, a planetary gear generator 30 driven by a rack and pinion gear (not shown) may be used to generate electricity from the displacement. In FIG. 6, the generator 30 is attached to and driven by the top piece 100 and the rack 110 is stationary, while in FIG. 7, the rack 110 is connected to the top piece 100 and the generator 30 is held stationary. As one skilled in the art will appreciate, the planetary gear generator 30 could be replaced by a spur-geared generator (not shown), or alternatively, the rack-gear box-generator combination could be replaced with a linear generator 30' as shown in FIG. 8.

Figure 8:
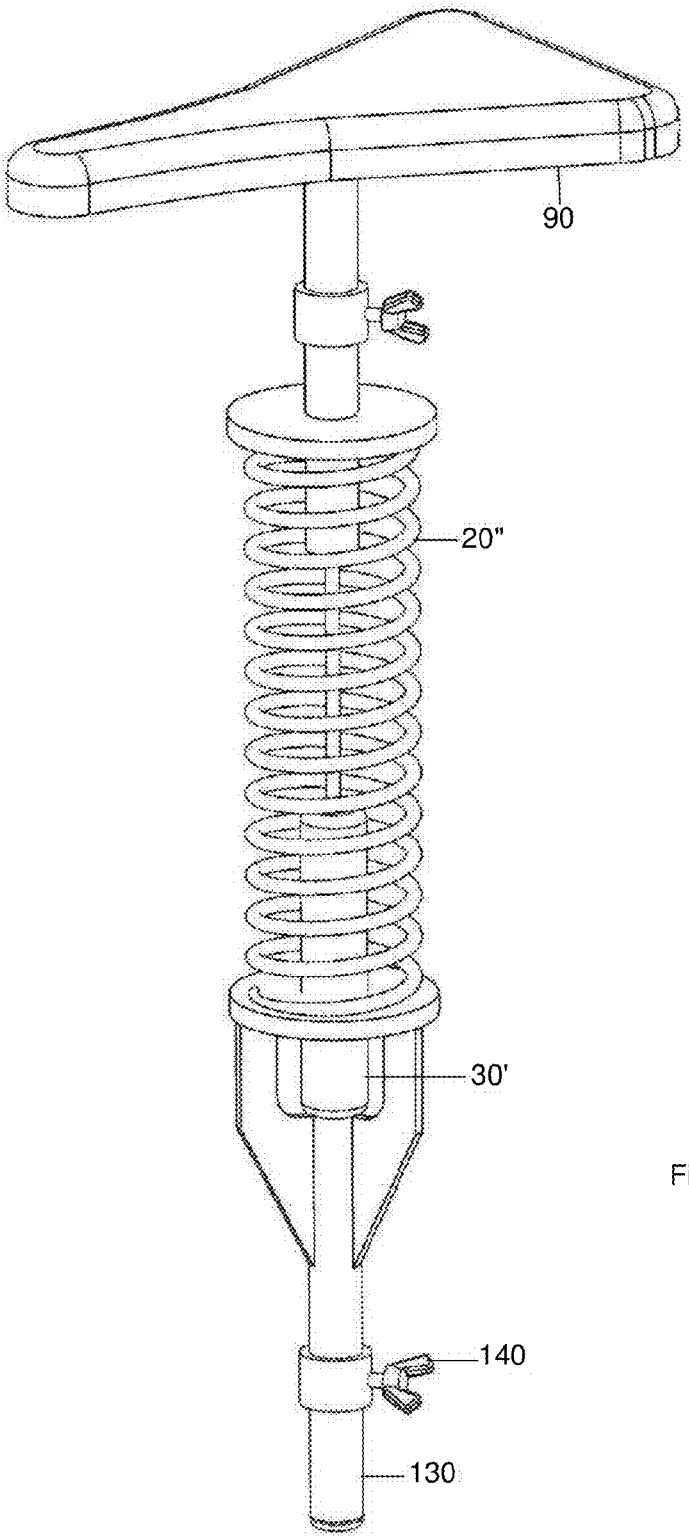
FIG. 8 illustrates a variation of the embodiment of FIG. 6 including a compressible spring and a linear generator.
Figure 9:
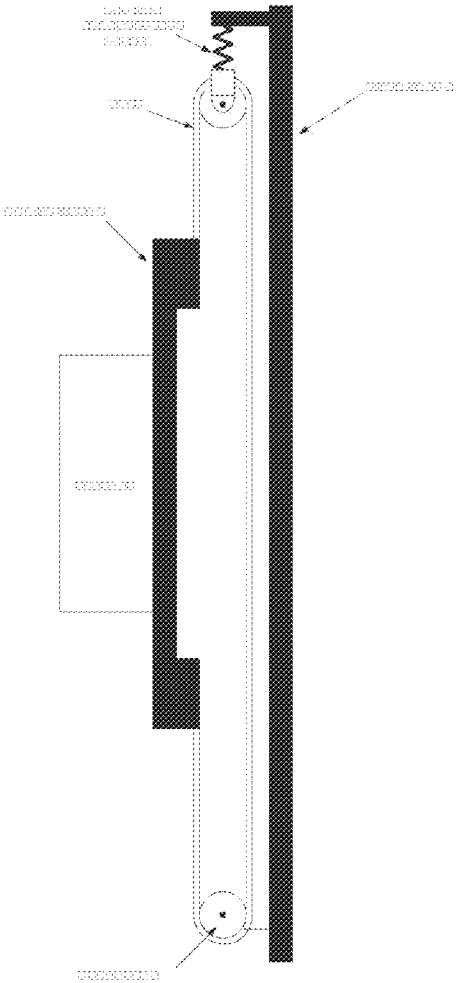
FIG. 9 illustrates embodiments in which the generator is driven by a belt instead of a rack and pinion gear.
Figure 9:
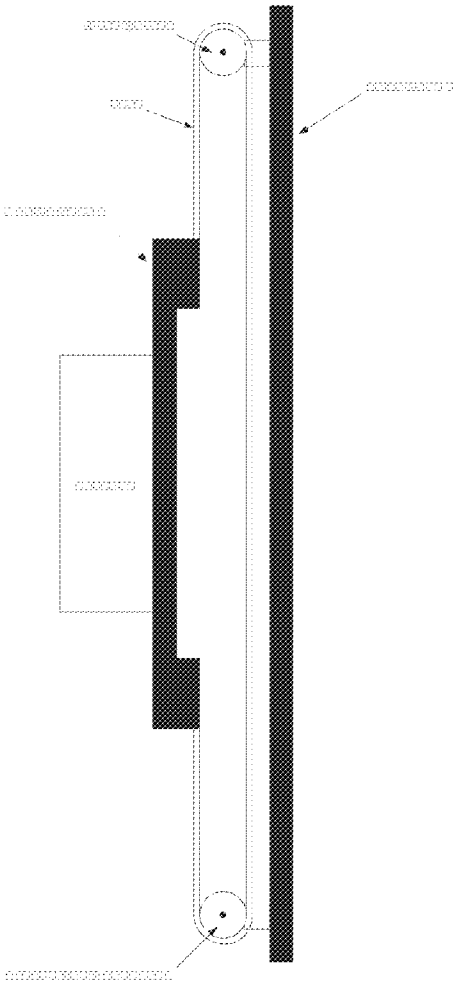

Those skilled in the art will realize that if the pole at the bottom of FIGS. 7 and 8 were single, similar to a crutch or pogo stick, then it would be light weight but would provide reduced stability. By having a tripod arrangement there would be stability, but added weight. The flat bottom 120 on the embodiment in FIG. 6 would be stable by itself.

The embodiment of FIG. 6-8 preferably embodies several important adjustments. First, the height of the seat 90 is preferably adjustable to accommodate for different lengths of the users' legs. In the case of embodiments in FIGS. 7 and 8, the length of the foot 130 can also be adjusted by adjusting wing nut 140 to help set the appropriate height of the seat 90 from the ground. Second, the spring 20' or 20" may be adjustable to accommodate different weights of individuals and how aggressively they transfer their weight to the seat. Adjusting the spring constant will allow them to alter the natural frequency to an optimum value.

Embodiments for Protection from Environment, Impact, and Reduction of Noise

Electrical generating systems, such as those illustrated in FIGS. 1-8, have three weaknesses for which the inventors have made design improvements. First, environmental exposure to dust, dirt and potentially water (including salt) can have a deleterious effect on many systems, but in particular the generator, the drive mechanism and the bearings allowing the load to move up and down. Further, these same areas are noise generation areas, so attempts to protect them from the environment can also lead to a reduction in noise. Finally, these devices must be able to survive impacts—not only must the frames of these devices survive impact, but a fall onto the ground from 3-10 feet, should the device land vertically, will lead to the moving part (in the case of the backpack, the weight in the pack) to move quickly past the stationary section which can cause damage to the drive mechanism, the generator, and possibly the electronics.

To address these issues, a linear planetary gear generator (rather than orthogonal with a single stage system) may be used that permits the gear box to be enclosed. Because the gear box is enclosed, it can be sealed to protect it against environmental insult including salt water. Enclosing the gears also leads to a reduction in noise because instead of a large aluminum gear (spur gear) resonating in open air, smaller gears may be enclosed in a sealed gear box. This, along with using a larger generator (which enables the same amount of electricity at lower RPMs), the overall noise reduction is 20 dB at frequencies over about 1000 Hz to which human hearing is more sensitive. Although planetary gear systems are not always as efficient as spur gear systems, an efficiency of 78-80% has been obtained by the inventors when the pack was driven up and down as occurs during walking, which is similar to that obtained with a spur gear system.

A linear generator may also be used that does not have mechanical gearing. This will reduce gear noise and the linear orientation will permit the generator to be sealed. However, those skilled in the art will appreciate that, generally speaking, the weight for a given amount of electricity will be larger for a linear generator than for a rotary generator.

The drive train/drive mechanism of the suspension system is also an area which can suffer environmental insult, noise and impact damage. This is simplified in the linear generator as there is no gearing. For rotary generators, however, there are generally two ways they could be actuated. One is with a rack and pinion system as described above with respect to FIGS. 6 and 7 and the other is with a belt drive as illustrated schematically in FIG. 9. Should the pack fall from a height and land vertically, the stationary frame will stop abruptly and the movable frame, which has a tremendous amount of kinetic energy, will keep on moving (particularly while on the back of a jumping wearer). There are two areas which can be damaged during this unusual event. First, the geared generator presents a large equivalent inertia to the rack. The rack and pinion gear can become damaged during such an event.

Two mechanisms also may be used to reduce the large inertia in the case of a vertical fall. The first is a slip clutch which will simply allow the rack to spin the pinion gear without a large back torque, which will prevent damage to the rack and pinion. Another mechanism is to spring load the rack, which slows the speed at which the rack moves past the pinion gear giving the generator more time to accelerate. Also, a belt drive as illustrated in FIG. 9*a* (with slip clutch 150) and FIG. 9*b* (with spring loading) also may have advantages in terms of susceptibility to environment insults including dirt, dust, and corrosion. However, it will still face the same impact issues described for the rack and pinion.

Another potential area of possible damage to the electricity generating device is the electronics. Should the generator rotate at a high rpm, the voltage generated could become very high and exceed the maximum rating of the electronics. In the simplest case, the electronics will be permanently damaged. However, if the electronics is damaged in such a way that it provides a short circuit to the generator, then the generator will likely seize, resulting in a large back torque, which will cause the gear train and drive mechanism to be permanently damaged. For this reason, it is desirable to provide an electronic mechanism that disconnects the electronics when the generator voltage goes too high and runs the current through a fixed resistor for dissipation as heat.

Because of significant moment exerted by the backpack load (force*distance) with respect to the bearing rods of the suspension system, it is generally desirable to use linear bearings. Linear bearings utilizing ball bearings are typically used, in which case the balls are generally made of hardened steel. In order to protect the rods from damage, the rod too is made of hardened steel. The problems with such a system for the electricity generating device of the invention are several fold. First, steel rods are extremely heavy, making the backpack too heavy to carry. For weight considerations, the steel rods must be replaced with thin-walled aluminum tubes. However, one cannot use the ball bearing bushings on the aluminum tubes because the tubes are too soft and the bearings will score the tubes. A hardened coating (i.e., electrolysis nickel) can be placed on the aluminum tubes to minimize the problem, but that increases the cost and the coating will eventually breakdown. Second, ball bearings rolling against metal make considerable noise. The balls click along the tube and the sound can be distracting to the wearer as well as annoying to others. Such a system would not be acceptable in military and law enforcement applications, for instance, where stealth is required.

Figure 10:
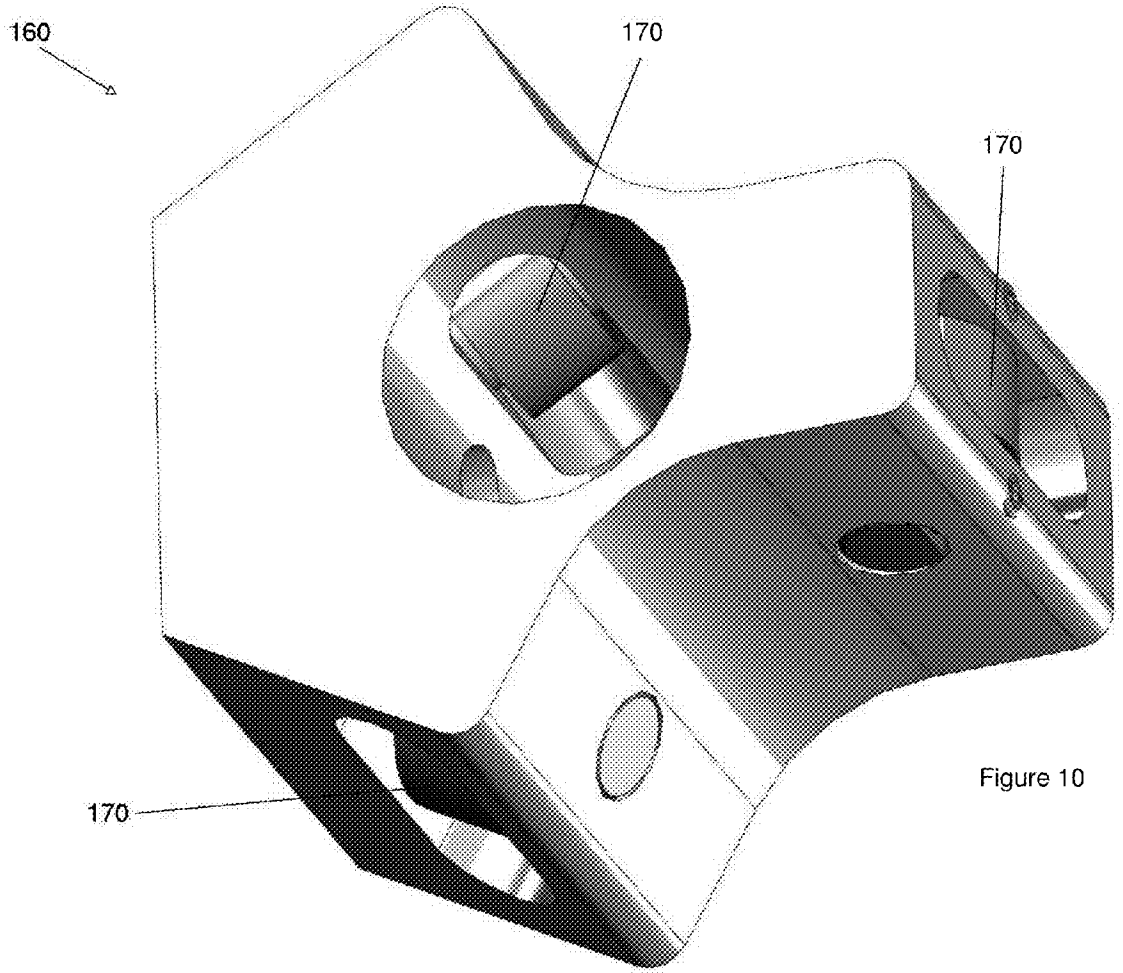
FIG. 10 illustrates a roller bearing assembly having three rollers situated at 120 angles around a vertical bearing rod for displacing the respective portions of the suspension system.

Accordingly, it is desirable to use a roller bearing assembly 160 of the type illustrated in FIG. 10 for enabling the respective portions of the suspension system to move relative to one another. As illustrated, the roller bearing assembly 160 in this exemplary embodiment consists of 3 rollers 170 situated at 120 angles around the vertical bearing rod. Because the rollers 170 are always in contact with the rod, there is little noise. Also, as there is no sliding movement of the rod with respect to the rollers 170, the rod does not get scored. Additional noise reduction is achieved by covering the roller bearing assembly 160 with thin Delrin sleeves.

However, the inventors note that there are problems with two facets of the roller bearing assembly design illustrated in FIG. 10. First, the roller bearing assemblies 160 rely on tight tolerances and it is possible that dust or sand could enter the roller bearing assembly 160 and cause it to seize (the roller bearing assemblies 160 are not self-cleaning) Second, during impact of the pack when dropped, the roller bearing assemblies 160 might exert a large force on the bearing rods which might bend the bearing rods so as to prevent normal movement of the pack.

Figure 11:
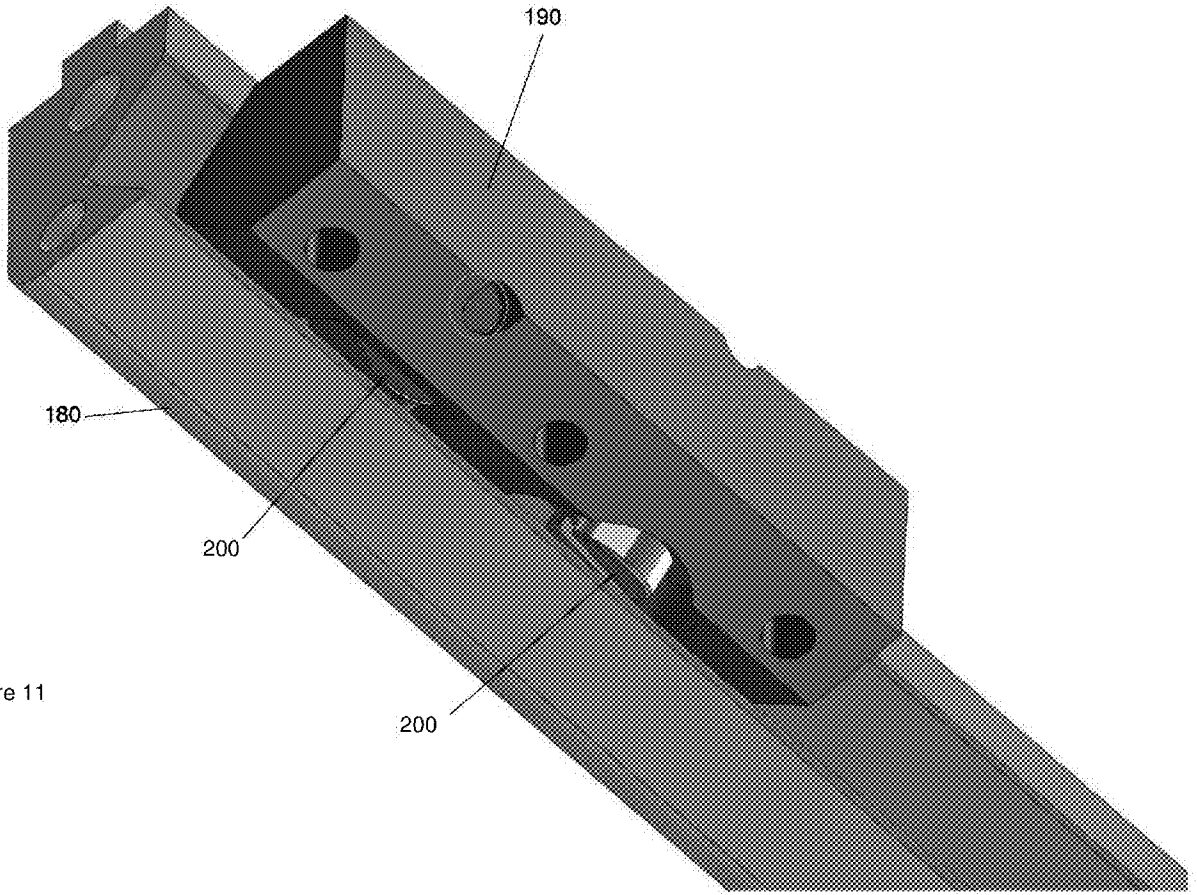
FIG. 11 illustrates a roller bearing assembly including a V-shaped track in which the arms of the V are 90 degrees from each other and a "cart" moves up and down the track using two orthogonal rollers that roll in the same plane as the respective arms of the V-shaped track.

To address these issues with the roller bearing assemblies of FIG. 10, the roller bearing assembly of FIG. 11 may be used instead as it requires looser tolerances, tends to be self cleaning, and will not become damaged or damage the rest of the suspension during impacts. In this design, there is a V-shaped track 180, in which the arms of the V are 90 degrees from each other. The "cart" 190 moving up and down the track has a point V shape that fits in the V formed by the track 180 but does not contact it. The cart 190 also contains two orthogonal rollers 200 that roll in the same plane as the respective arms of the track 180.

Power Monitoring System

Electricity power output with the electricity generating backpack described herein depends on the amount of weight carried, the speed of walking, the style of the gait (i.e. vertical excursion of the hip), the natural frequency of the system, and resistor emulation by the electronics. In particular, subtle changes in gait can have a significant effect on power generation. When learning to use the electricity-generating backpack, it is necessary to give the wearer immediate feedback on power generation so that they can learn to optimize their gait for electricity-generation. In addition, the backpack can be tuned for wearer or conditions in terms of the natural frequency by adjusting the spring constant and also by adjusting the resistance emulated by the electronics. By having feedback the user can determine what is the best combination for that terrain.

Not only is it important for the user to determine the instantaneous power production, but it is also important for the user to keep track of the cumulative energy with which they have charged the batteries. The electricity-generating backpack can provide its users with electricity-independence. To do this, one has to determine how much total energy is used per day and then the backpack must charge the battery with an equivalent amount of electrical energy. For instance, US Marines have been observed to use an average of 5 W of electricity over 24 hours. This is equivalent to 120 W-hrs per day. The wearer would need to come up with a strategy to generate 120 W-hrs per day by walking or hand pumping. By keeping track of how much energy is generated, the user can determine how much more has to be done.

These capabilities are desirable to not only effectively use the backpack embodiments but also the seat generator embodiments described above. For instance, how vigorously one applies force to the seat (depending on frequency, the amount of leg bend, etc.) will alter the power generation. Further, knowing how much energy needed to generate provides the appropriate incentive to continue the task.

Thus, in an exemplary embodiment, the electricity generating device of the invention includes a sensor network and recording system that measures the generated power and other parameters. For instance, it should be recognized that forces exerted on the body by carrying heavy loads is a leading cause of musculoskeletal injury. Hence, ergonomics can be improved by providing the wearer with feedback on the magnitude of forces during different locomotory behaviors. Thereby, wearers who carry heavy loads can learn to walk in a manner that minimizes forces on the body.

A backpack sensing/actuation network founded on an SMBus physical bus topology network may be used with the electricity generator for this purpose. Such a network preferably includes a display node, a power monitoring node, and a transducer monitoring node. A power monitor may be connected to the network via a network cable or via a wireless connection and is positioned between the generator and the power electronics to measure (sample) the voltage and current passing therethrough. The power monitor includes a microcontroller that A/D converts the measured voltage and current, computes the power (P=VI) from the measured values, and cumulates (integrates) the measured power for display of the cumulated electrical energy. The measured values may be integrated with time and may be reset upon pressing of a reset button. The display node performs periodic read transactions from both the power and transducer monitoring nodes. This data is displayed and is sequentially stored in an micro SD FLASH memory which may be configured as a virtual tape drive. At boot-up, the display node searches for the power and transducer monitoring node related portals. If found, run-time data acquisition for these nodes are enabled. During run-time, acquired readings are cumulated and displayed on an alphanumeric LCD display for the user in a conspicuous location on the electricity generating device (e.g., shoulder straps of a backpack). The display features multiple display modes consisting of two types: output modes where acquired variable values are displayed and command modes where users can initiate actions. The display implements at least four user actions including: 1) format onboard tape drive; 2) reset power monitor energy accumulator; 2) start recording; and 4) stop recording. The sensory data is acquired from remote nodes at 10 msec intervals while display outputs are updated at 250 msec intervals. The display features two buttons for the user to browse through display modes (left and right single press) and select user actions (double press).

In an exemplary embodiment, the power monitoring node measures the instantaneous voltage and current output of the backpack power source (i.e. the rectified generator). The raw measurements are passed through a calibration map (a piecewise linear function) that produces unit-less normalized quantities which are smoothed out by a low-pass FIR filter to eliminate the noise. The node also computes auxiliary variables: 1) instantaneous electrical power; 2) accumulated electrical energy; 3) 10 sec average power; 4) 1 minute average power; and 5) 30 min average power. The power monitoring node is preferably located between the generator and electronics for processing and storing the generated electricity. The power monitoring node measures and cumulates (integrates) over time the power generated by the generator for display on a display of the power monitoring node. Of course, other power monitoring devices may be used to measure the generated power and other desirable parameters.

It should be understood that this invention is not limited to the particular embodiments disclosed, but it is intended to cover modifications within the spirit and scope of the present invention as defined by the appended claims. All such modifications of the invention are intended to be covered by the appended claims.

What is claimed is:

1. A human powered electricity generator, comprising:

a suspension system including a compliant mechanism that permits a first portion of said suspension system to be displaced relative to a second portion of said suspension system as a result of an application of force to the first or second portions of the suspension system;

a generator that converts a mechanical displacement of said first portion of said suspension system with respect to said second portion of said suspension system into electrical energy; and displacement means connected to either said first portion or said second portion of said suspension system for enabling a user to manually displace the first portion of said suspension system with respect to said second portion of said suspension system, wherein the displacement means includes a seat adapted to accept the weight of a user to displace said first portion of said suspension system with respect to said second portion of said suspension system in response to the application of the user's weight to the seat at the top of a displacement stroke and to buoy the user back up at the bottom of the displacement stroke when the user extends his legs, wherein the displacement means comprises a spring and adjustment means for adjusting a spring constant of the spring to alter a natural displacement stroke frequency to an optimum value so as to accommodate different weights of users.

2. The electricity generator of claim 1, wherein the compliant mechanism comprises at least one extensible spring.

3. The electricity generator of claim 1, wherein the compliant mechanism comprises at least one compressible spring.

4. A human powered electricity generator, comprising:

a suspension system including a compliant mechanism that permits a first portion of said suspension system to be displaced relative to a second portion of said suspension system as a result of an application of force to the first or second portions of the suspension system;

a generator that converts a mechanical displacement of said first portion of said suspension system with respect to said second portion of said suspension system into electrical energy; and displacement means connected to either said first portion or said second portion of said suspension system for enabling a user to manually displace the first portion of said suspension system with respect to said second portion of said suspension system, wherein said suspension system further comprises a roller bearing assembly that permits said first portion of said suspension system to be displaced relative to said second portion of said suspension system along at least one rod as a result of said application of force to the first or second portions of the suspension system, said roller bearing assembly comprising three roller bearings situated at approximately 120 degree angles around and in contact with said at least one rod.

5. A human powered electricity generator, comprising:

a suspension system including a compliant mechanism that permits a first portion of said suspension system to be displaced relative to a second portion of said suspension system as a result of an application of force to the first or second portions of the suspension system;

a generator that converts a mechanical displacement of said first portion of said suspension system with respect to said second portion of said suspension system into electrical energy; and displacement means connected to either said first portion or said second portion of said suspension system for enabling a user to manually displace the first portion of said suspension system with respect to said second portion of said suspension system, wherein said suspension system further comprises a roller bearing assembly that permits said first portion of said suspension system to be displaced along a V shaped track relative to said second portion of said suspension system as a result of said application of force to the first or second portions of the suspension system, said roller bearing assembly comprising a cart that moves up and down respective orthogonally disposed arms of said V shaped track in response to said application of force, said cart having at least two orthogonal rollers that roll in respective planes of said respective orthogonally disposed arms of said V shaped track.

* * * * *